US006523378B2

(12) United States Patent
Kuo

(10) Patent No.: US 6,523,378 B2
(45) Date of Patent: Feb. 25, 2003

(54) PUSH-LOCK

(76) Inventor: Lambert Kuo, No. 16, Lane 459, Sec. 1, An Ho Rd., Tainan (TW)

( * ) Notice: Subject to any disclaimer, the term of this patent is extended or adjusted under 35 U.S.C. 154(b) by 0 days.

(21) Appl. No.: 09/852,422

(22) Filed: May 9, 2001

(65) Prior Publication Data

US 2002/0166356 A1 Nov. 14, 2002

(51) Int. Cl.[7] ..... E05B 23/00

(52) U.S. Cl. ..... 70/360; 70/361; 70/100; 70/DIG. 20; 70/367; 70/370

(58) Field of Search ..... 70/360, 361, DIG. 20, 70/DIG. 79, 100, 367, 368, 369, 370, 371, 466, 451

(56) References Cited

U.S. PATENT DOCUMENTS 3,919,866 A * 11/1975 Lipschutz ..... 292/170
4,009,599 A * 3/1977 Patriquin ..... 70/100
5,133,203 A * 7/1992 Huang ..... 70/360
5,447,049 A * 9/1995 Shieh ..... 70/360
5,799,520 A * 9/1998 Laabs et al. ..... 200/318.2
5,907,963 A * 6/1999 Myers et al. ..... 70/371
6,010,289 A * 1/2000 DiStasio et al. ..... 411/174
6,098,434 A * 8/2000 Liou ..... 70/360

* cited by examiner

*Primary Examiner*—Anthony Knight
*Assistant Examiner*—Chris Boswell
(74) *Attorney, Agent, or Firm*—Heller Ehrman White & McAuliffe LLP

(57) ABSTRACT

A push-lock includes a body. The body is formed with a channel having a pair of portions. A cylinder is movable in the body between a front position and a rear position, and has a latch rotatably connected thereto. The latch defines two opposed cutouts in a periphery thereof. A clip has a pair of shanks resiliently flexible in the portions of the channel. The shanks normally abut the periphery of the latch. A spring is provided for moving the cylinder back to the front position. Additionally, the latch can be turned relative to the cylinder in such a manner that the shanks snapped in the cutout may be pushed outward by the turning latch till the shanks fully slide out of the cutouts and abut the periphery of the latch again.

5 Claims, 5 Drawing Sheets

PUSH-LOCK

BACKGROUND OF THE INVENTION

1. Field of the Invention

The present invention relates to a push-lock and, more particularly, to a push-lock which is simple in structure and easy to be assembled.

2. Description of Related Art

Push-locks are known for their closing in a manner of simply depressing cylinders. As shown in FIG. 8, a well-known push-lock includes a tubular body (70) having a rotary inner cylinder (71) and a latch (72) movably and rotatably received in the cylinder (71). The latch (72) has a back spring (73) compressed between the inner cylinder (71) and a retainer (74) fastened thereto, and a bore (75) for receiving a laterally movable pin (76).

The laterally movable pin (76) is further spring-loaded by a secondary spring (77) in such a way that the pin (76) may be extended into a curved groove (78) defined in the cylinder (71) when the latch (72) is depressed, i.e. moved relative to the cylinder (71) in a direction as denoted by an arrow in FIG. 8, thus fastening the latch (72) to the cylinder (71) and in turn to the tubular body (70), via the movable pin (76).

The push-lock can only be opened by turning the rotary cylinder (71) relative to the latch (72) with a correct key (not shown). As a result of the rotation of the cylinder (71), the pin (76) will be pressed back into the bore (75) by a wall defining the curved groove (78), thereby allowing the latch (72) to be moved back to its original position under the action of the back spring (73).

FIG. 9 shows another push-lock substantially similar to the one described above. This push-lock includes a rotary cylinder (80) having an off-centered cam (81) for operating a laterally movable pin (82) disposed in a backward-extending latch (83). The latch (83) and the rotary cylinder (80) are movable together axially in a tubular body (84) and tend to be moved by a back spring (86) to a front position relative to the tubular body (84).

However, the movable pin (82) is urged by a secondary spring (85) in such a way that the pin (82) may be extended into a hole (841) defined in the tubular body (84) when the cylinder (80) is depressed, thereby fastening the latch (83) to the tubular body (84), via the movable pin (82).

This push-lock can be opened by turning the rotary cylinder (80) with a correct key (not shown). As a result, the laterally movable pin (82) is moved downward by the off-centered cam (81) of the turning cylinder (80). At the moment when the pin (82) is released from the hole (841) of the tubular body (84), the latch (83) and the cylinder (80) are moved back to their original or front position by the action of the back spring (86).

Although the two push-locks can be closed simply by depressing the latch (72) or the cylinder (80), they share a common problem of having a complicated structure, which will increase the production cost.

One of the resolutions to the above-mentioned problem is disclosed in a push-lock of a different type, as shown in FIG. 10. The push-lock here includes a tubular body (90) formed with a longitudinal groove (91) and an L-shaped slot (92), with a cylinder (93) being movable in the tubular body (90) between a front position and a rear position, via a stud (not numbered) extending from the cylinder (93) into the longitudinal groove (91).

The cylinder (93) is formed with a rotary latch (94) that has an integral flange (95) rotatably connected to the cylinder (93), with a pin (97) extending from the flange (95) into the L-shaped groove (92) of the tubular body (90). The rotary latch (94) is further spring-loaded by a pre-twisted spring (96) in such a way that the rotary latch (94) may have a tendency to turn with respect to the body (90).

Therefore, the pin (97) will slide into the circumferential stop portion of the L-shaped groove (92), due to the tendency of the latch (94), when the cylinder (93) is depressed, i.e. moved from its front position to its rear position against the action of the spring (96). This fastens the latch (94) and hence the cylinder (93) to the tubular body (90).

The push-lock here is also opened by turning the rotary latch (94) relative to the cylinder (93) with a correct key (not shown). Once the latch (94) is turned so that the pin (97) is released from the circumferential stop portion of the groove (92), the cylinder (93) with the rotary latch (94) will be moved back from the rear position back to the front position.

This push-lock is simplified in structure. However, it is not easy to be assembled, for the action of the pre-twisted spring (96) makes the pin (97) much harder to be extended correctly into the flange (97) through the groove (92) of the body (90).

Therefore, it is an objective of the invention to provide a push-lock to mitigate and/or obviate the aforementioned problems.

SUMMARY OF THE INVENTION

The object of the present invention is to provide a push-lock which is simple in structure.

Another object of the present invention is to provide a push-lock which is easy to be assembled.

Other objects, advantages and novel features of the invention will become more apparent from the following detailed description when taken in conjunction with the accompanying drawings.

DETAILED DESCRIPTION OF THE PREFERRED EMBODIMENT

Figure 1:
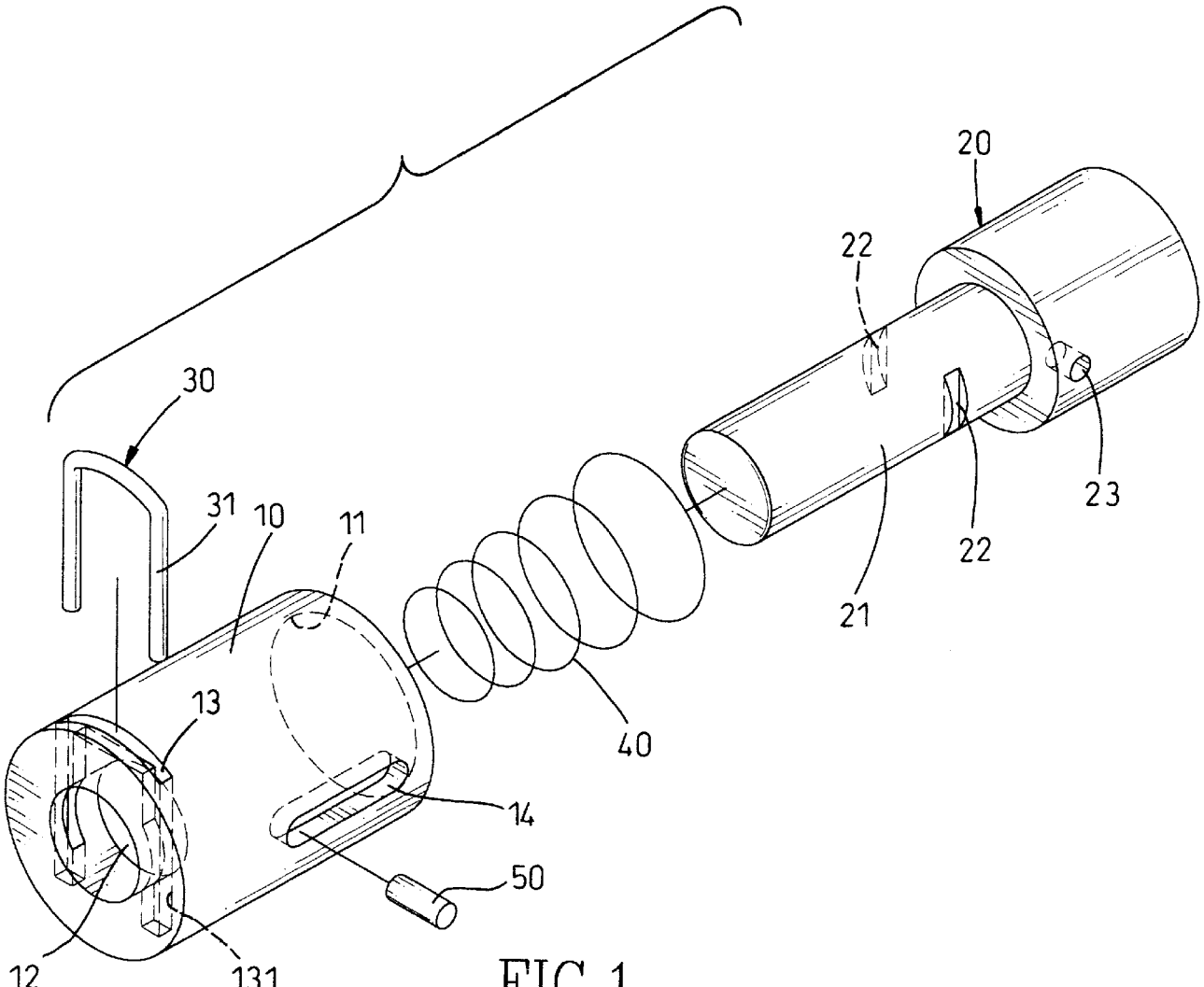
FIG. 1 is an exploded perspective view of preferred embodiment of a push-lock in accordance with the present invention.

Referring to FIG. 1, a push-lock in accordance with the present invention includes a body (10) having a front opening (11) and a rear opening (12) in communication with each other, and preferably a longitudinal groove (14) defined therein.

Figure 3:
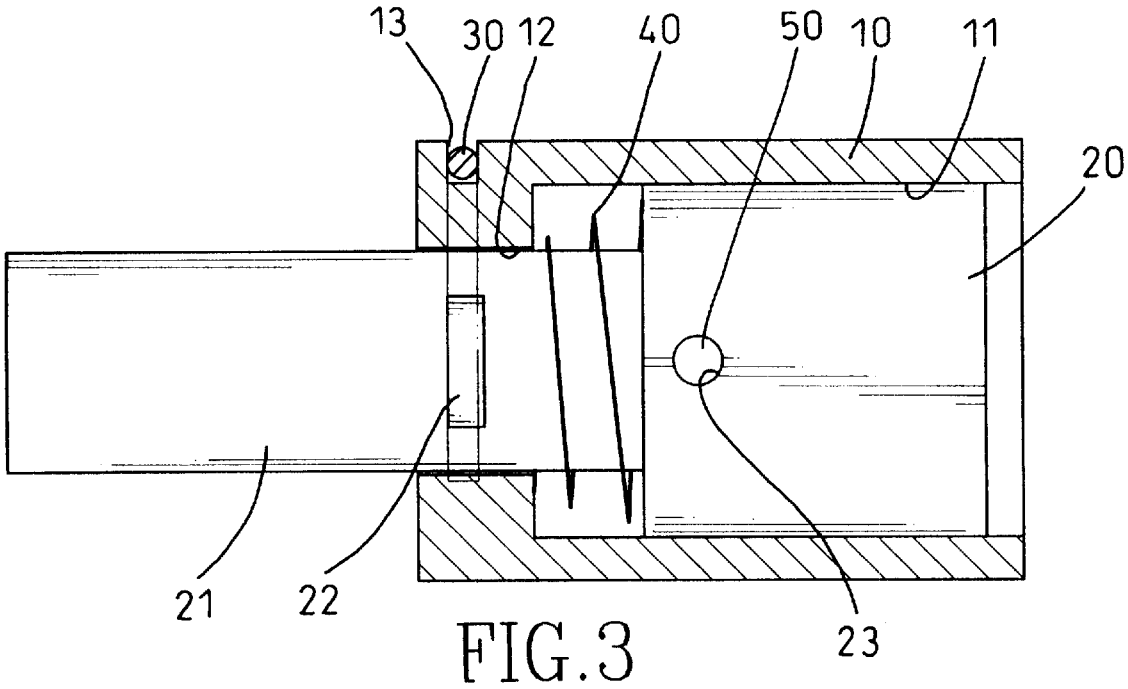
FIG. 3 is a cross-sectional view showing the push-lock of FIG. 1 in a locked position.
Figure 2:
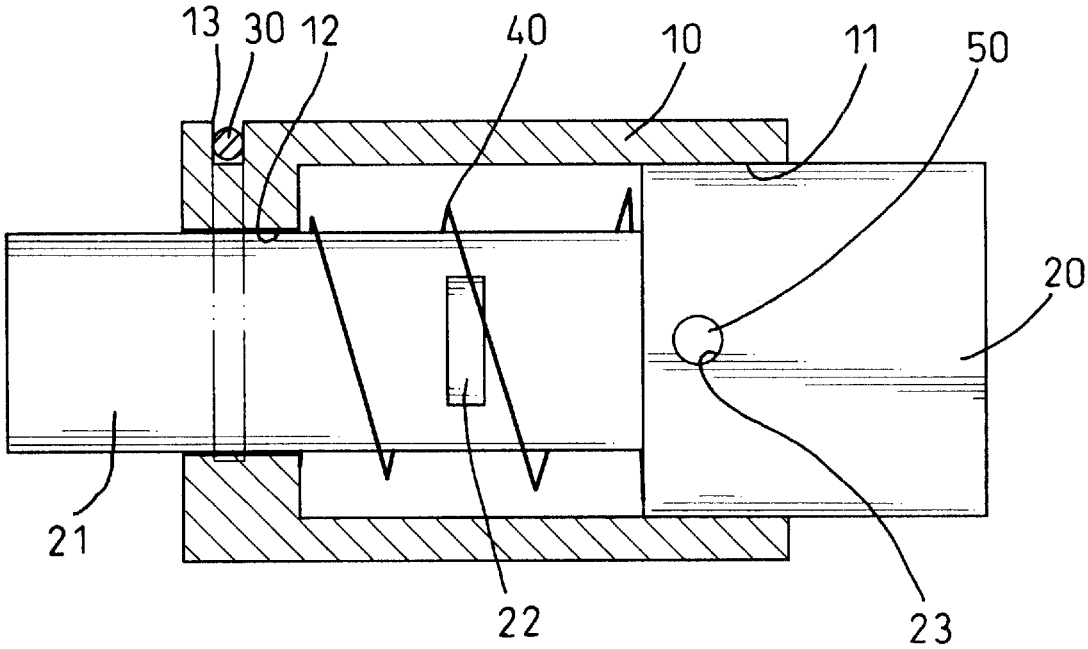
FIG. 2 is a cross-sectional view showing the push-lock of FIG. 1 in an unlocked position.

A cylinder (20) is movably fitted in the front opening (11) of the body (10). The cylinder (20) includes a latch (21) rotatably connected thereto and extending backward through the rear opening (12), with a pair of opposed cutouts (22) defined in a periphery of the latch (21). Furthermore, the cylinder (20) has a hole (23) for receiving a stud (50) that extends into and is movable along the longitudinal groove (14), thereby ensuring the correct movement of the cylinder (20) between a front position, as shown in FIG. 2, and a rear position, as shown in FIG. 3, with respect to the body (10).

Figure 5:
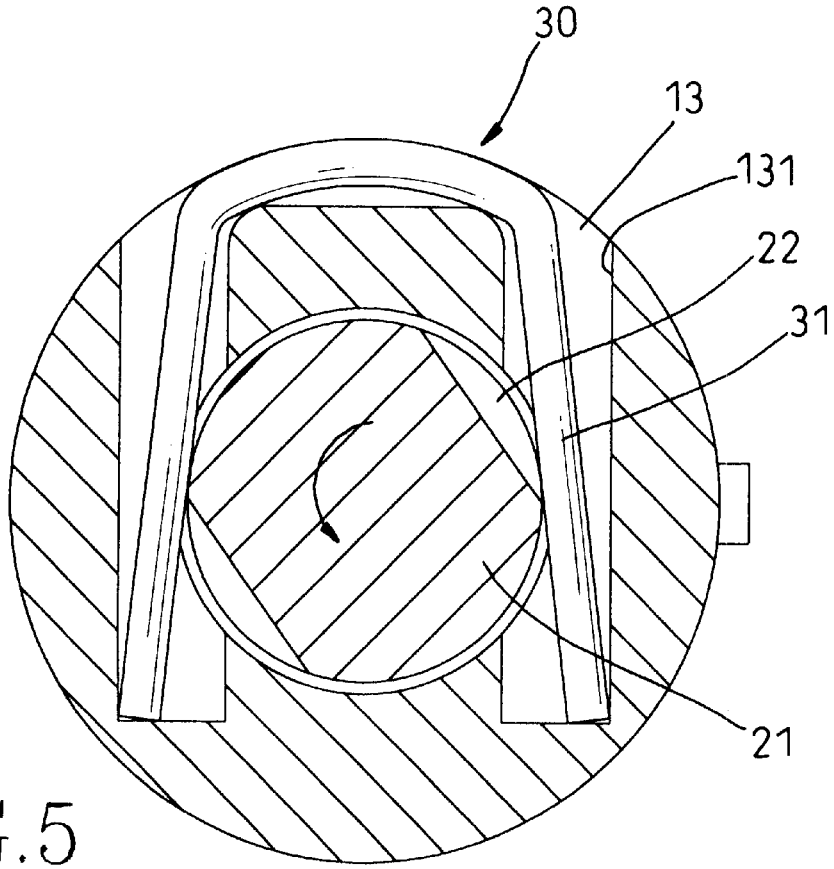
FIG. 5 is a cross-sectional end view showing the push-lock of FIG. 1 is released from its locked position.
Figure 4:
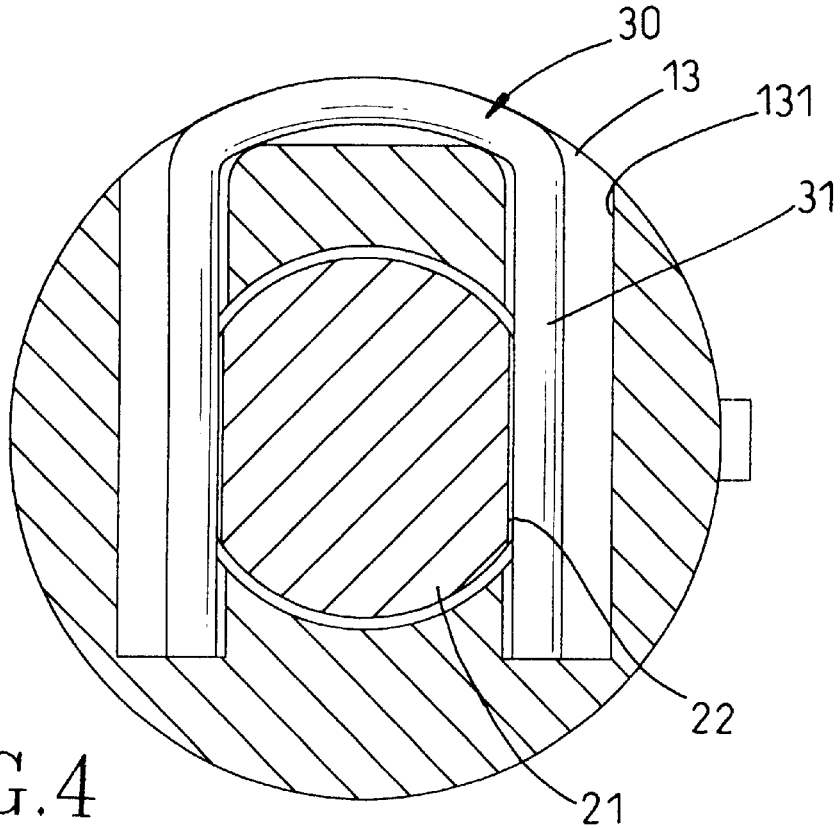
FIG. 4 is a cross-sectional end view showing the push-lock of FIG. 1 in the locked position.

In the preferred embodiment, the body (10) further includes a channel (13) for receiving a clip (30) having a U-shaped configuration. The channel (13) here has a lateral portion (not numbered) laterally defined in the body (10) and a pair of straight portions (131) that are defined in a face defining the lateral portion and communicate the rear cylindrical opening (12) of the body (10) substantially at two opposed tangential points, as best seen in FIGS. 4 and 5.

The U-shaped clip (30), received in the matching channel (13), has a lateral rod (not numbered) received in the lateral portion of the channel (31) and a pair of shanks (13) respectively extending from two ends of the lateral rod and resiliently flexible in the straight portions (131). The shanks (31) normally abut the periphery of the latch (21) but snap into the cutouts (22) and catch the latch (21) when the cylinder (20) is moved to its rear position, thereby releasably [releasibly] fastening the latch (21) to the clip (30) and hence to the body (10).

In addition, a spring (40) is accommodated in the front cylindrical opening (11) and mounted around the latch (21) for returning the cylinder (20) to its front position, especially once the latch (21) is released from the clip (30).

Referring to FIG. 2, the inventive push-lock can be assembled simply by placing the spring (40) in the front cylindrical opening (11) of the body (10) and then inserting the latch (21) into the same spring (40). Once the stud (50) extends through the groove (14) and into the hole (23), the cylinder (20) will never separate from the body (10). The assembly is finished by inserting the U-shaped clip (30) in place in the channel (13), in which the clip (30) will remain.

Referring to FIG. 3, the push-lock is locked by depressing the cylinder (20), i.e. by moving it from the front position to the rear position. It is in the rear position that the resilient shanks (31) of the clip (30) will snap into the cutouts (22) of the cylinder (20), thereby catching the latch (21) and keeping it in a position extended far from the body (10), as best shown in FIG. 4.

Referring to FIGS. 4 and 5, the push-lock can only be opened by turning the latch (21) relative to the cylinder (20), such as by means of a correct key (not shown) that is inserted into a keyslot defined in the cylinder (20). As a result, the shanks (31) are both pushed outward by the turning latch (21). When the shanks (31) fully slide out of said cutout (22) and abut the periphery of the latch (21) again, as shown in FIG. 5, the cylinder (20) will be moved quickly from its rear position (FIG. 3) back to its front position (FIG. 2) by action of the spring (40).

Figure 7:
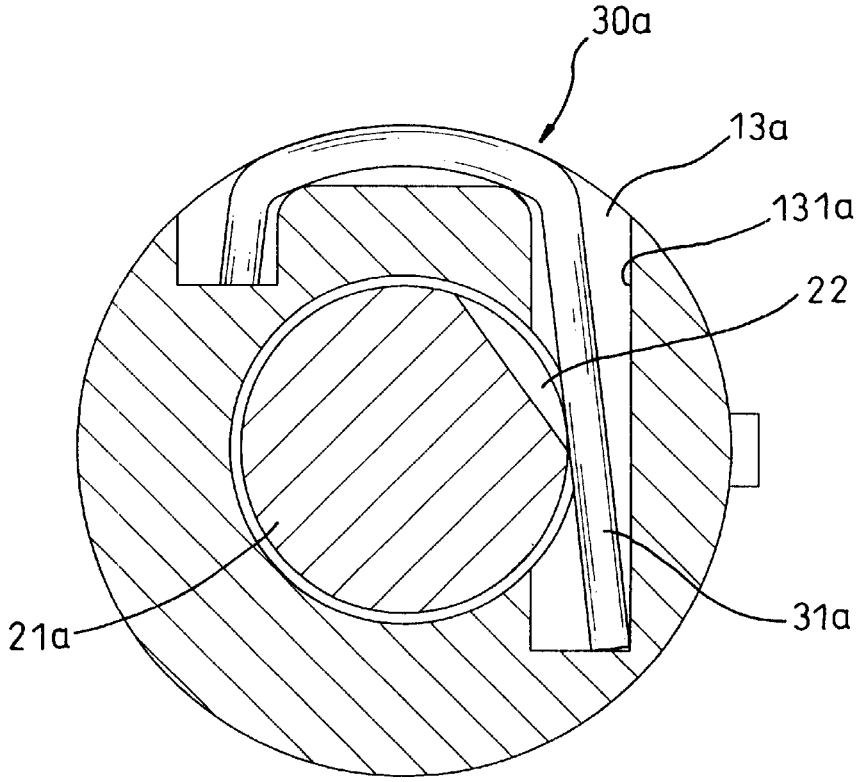
FIG. 7 is a cross-sectional end view showing the push-lock of FIG. 6 is released from its locked position.
Figure 6:
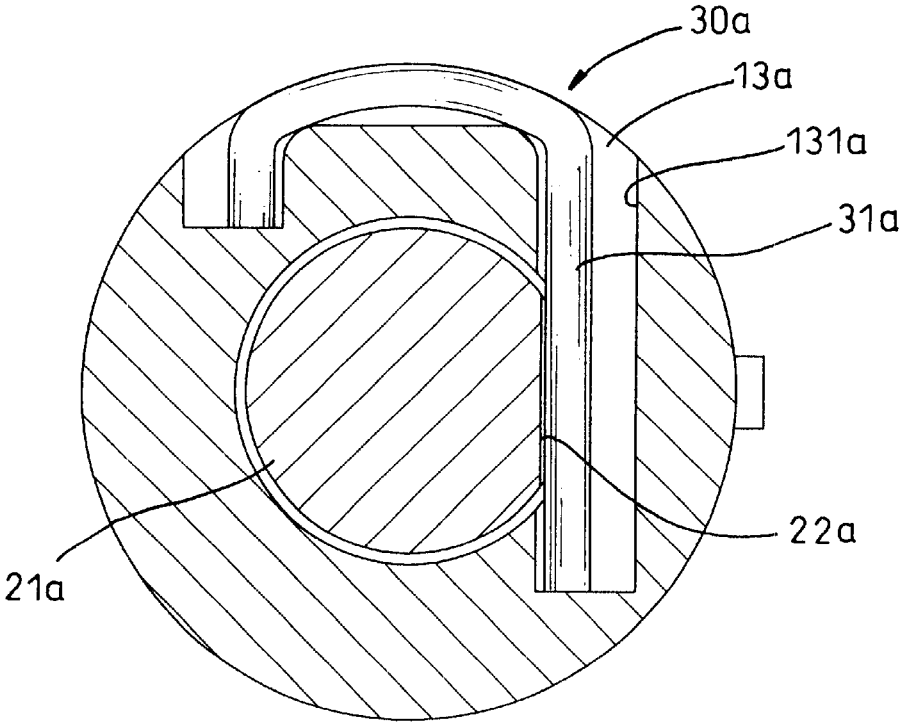
FIG. 6 is a cross-sectional end view of an alternative embodiment of a push-lock in accordance with the present invention, showing it in a locked position.
Figure 8:
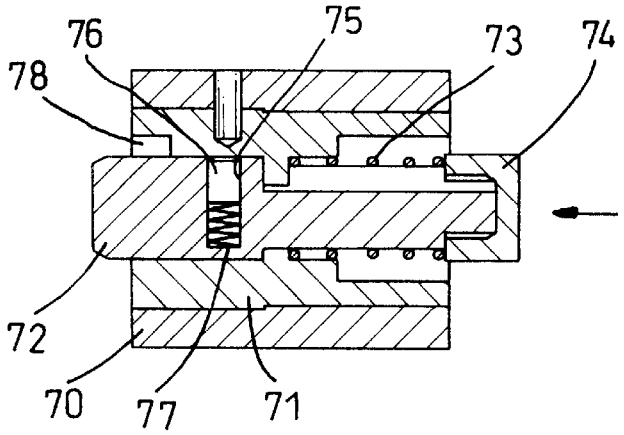
FIG. 8 is a cross-sectional view of a conventional push-lock.
Figure 9:
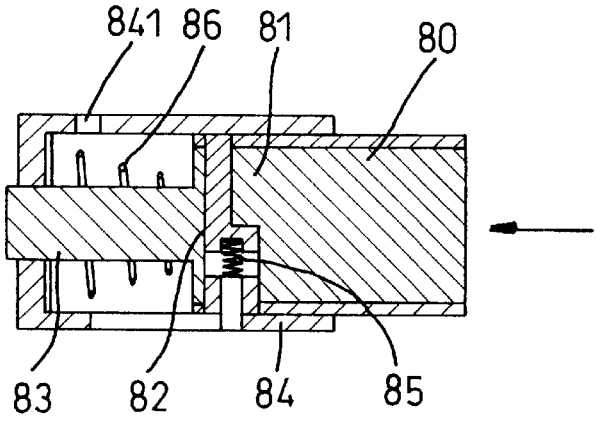
FIG. 9 is a cross-sectional view of another conventional push-lock substantially similar to the one shown in FIG. 8.
Figure 10:
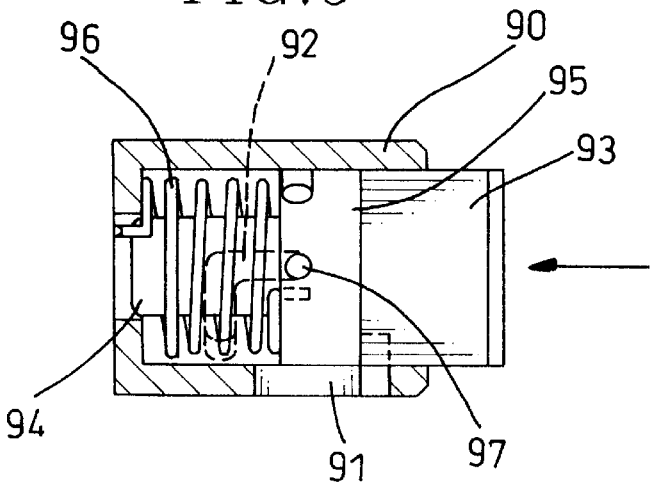
FIG. 10 is a cross-sectional view of a conventional push-lock of a type quite different from those shown in FIGS. 8 and 9.

It is to be noted that the clip (30) may have any other configuration that can keep the latch (21) of the cylinder (20) in the rear position. As shown in FIGS. 6 and 7, a clip (30*a*) having an L-shaped configuration with one single shank (31*a*) can also be used.

In this case, a channel (13*a*) of the body (10) may be formed with only one straight portion (131*a*) communicating a rear cylindrical opening (12*a*) substantially at one tangential point, and a latch (21*a*) may have only one cutout (22*a*) defined therein. The L-shaped clip (30*a*) is received in the channel (13*a*) with the single shank (31*a*) being resiliently flexible in the portion (131*a*). Similar to the embodiment of the U-shaped configuration, the single shank (31*a*) normally abuts the periphery of the latch (21*a*) but snaps into the cutout (22*a*) and catches the latch (21*a*) when the cylinder (20) is moved to the rear position.

From the above description, it is apparent that the invention has the following advantages:

1. being simple in structure:

Because the clip (30, 30*a*) is integrally formed with the resiliently flexible shank(s) (31, 31*a*), which function(s) as a movable pin urged by a separate spring as in the prior arts, the inventive push-lock is simple in its structure.

2. being easy to be assembled:

Because the inventive push-lock can be assembled simply by inserting the clip (30, 30*a*) into the channel (13, 13*a*), it is easy to be assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A push-lock comprising:

a body (10) having a front opening (11) and a rear opening (12) in communication with said front opening (11), said body (10) being formed with a channel (13, 13*a*) having a lateral portion laterally defined in the body (10) and at least one straight portion (131, 131*a*) defined in a face defining the lateral portion and communicating with said rear opening (12) substantially tangentially;

a cylinder (20) movable in said front opening (22) of said body (10) between a front position and a rear position, said cylinder (20) having a latch (21, 21*a*) rotatably connected thereto and extending backward through said rear opening (12), said latch (21, 21*a*) defining at least one cutout (22, 22*a*) in a periphery thereof;

a clip (30, 30*a*) received in said channel (13, 13*a*) of said body (10) and having a lateral rod received in the lateral portion of the channel (13, 13*a*) and at least one shank (31, 31*a*) extending from the lateral rod and resiliently flexible in said straight portion (131, 131*a*) of said channel (13, 13*a*), said shank (31, 31*a*) normally abutting said periphery of said latch (21, 21*a*) but snapping into said cutout (22, 22*a*) and catching said latch (21, 21*a*) when said cylinder (20) is moved to said rear position; and a spring (40) for moving said cylinder (20) back to said front position;

wherein said latch (21, 21*a*) can be turned relative to the cylinder (20) in such a manner that said at least one shank (31, 31*a*) snapped in said cutout (22, 22*a*) may be pushed outward by said turning latch (21, 21*a*) until said shank (31, 31*a*) fully slides out of said cutout (22, 22*a*) and abuts said periphery of said latch (21, 21*a*) again before said cylinder (20) will be moved back to said front position by action of said spring (40).

2. The push-lock as claimed in claim 1, wherein said body (10) has a longitudinal groove (14) defined therein, and wherein said cylinder (20) has a stud (50) extending into and movable along said longitudinal groove (14) of said body (10), thereby limiting the movement of said cylinder (20) in a range between said front position and said rear position.

3. The push-lock as claimed in claim 1, wherein said cylinder (20) is configured so that said latch (21, 21*a*) can only be turned relative to said cylinder (20) by turning a correct key inserted in said cylinder (20).

4. The push-lock as claimed in claim 1, wherein said clip (30) has a U-shaped configuration with a pair of shanks (31), and wherein said latch (21) defines two opposed cutouts (22) in said periphery thereof, said channel (13) of said body (10) is shaped to receive said clip (30) and has a pair of straight portions (131) allowing said shanks (31) to be resiliently flexible therein, thereby enabling said shanks (31) to normally abut said periphery of said latch (21) but to snap into said cutouts (22) and catch said latch (21) when said cylinder (20) is moved to said rear position.

5. The push-lock as claimed in claim 1, wherein said clip (30*a*) has an L-shaped configuration with one single shank (31*a*), and wherein said latch (21*a*) defines one cutout (22*a*) in said periphery thereof, said channel (13*a*) of said body (10) is shaped to receive said clip (30*a*) and has one straight portion (131*a*) allowing said single shank (31*a*) to be resiliently flexible therein, thereby enabling said single shank (31*a*) to normally abut said periphery of said latch (21*a*) but to snap into said cutout (22*a*) and catch said latch (21*a*) when said cylinder (20) is moved to said rear position.

* * * * *